United States Patent [19]

Kondo et al.

[11] Patent Number: 4,922,796

[45] Date of Patent: May 8, 1990

[54] MUSICAL-TONE-GENERATING-CONTROL APPARATUS

[75] Inventors: Masao Kondo; Takashi Ishida, both of Hamamatsu, Japan

[73] Assignee: Yamaha Corporation, Hamamatsu, Japan

[21] Appl. No.: 317,943

[22] Filed: Mar. 1, 1989

[30] Foreign Application Priority Data

Mar. 8, 1988 [JP] Japan ..... 63-54570

[51] Int. Cl.[5] ..... G10H 1/06; G10H 1/22; G10H 7/00

[52] U.S. Cl. ..... 84/618; 84/622; 84/DIG. 2

[58] Field of Search ..... 84/608, 618, 622–625, 84/DIG. 2

[56] References Cited

U.S. PATENT DOCUMENTS 3,999,458 12/1976 Suzuki ..... 84/DIG. 2
4,159,663 7/1979 Aoki et al. ..... 84/618
4,213,366 7/1980 Niimi et al. ..... 84/618 X
4,342,248 8/1982 Deutsch et al. ..... 84/618 X
4,387,617 6/1983 Kato et al. .
4,553,465 11/1985 Kawashima et al. .
4,747,332 5/1988 Uchiyama et al. ..... 84/DIG. 2

FOREIGN PATENT DOCUMENTS 59-189394 10/1984 Japan .

*Primary Examiner*—Stanley J. Witkowski
*Attorney, Agent, or Firm*—Spensley Horn Jubas & Lubitz

[57] ABSTRACT

A musical-tone-generating-control apparatus including a number of musical-tone-signal-generating channels, each of which generates musical-tone signals having tone pitches designated by tone-pitch information and having tone colors determined by tone-color information. These tone-pitch information and tone-color information are supplied to a musical-tone-signal-generating channel selected by predetermined rules. One of the rules is that a newly entered key-code is assigned to a musical-tone-signal-generating channel which has been generating a musical-tone signal whose tone color is the same as that of the newly entered key-code. Thus tone-color-control parameters need not be transferred to the channel, and this saves time necessary for the transfer, resulting in a speeding up of processing. Other similar rules are also used resulting in similar advantages.

14 Claims, 7 Drawing Sheets

MUSICAL-TONE-GENERATING-CONTROL APPARATUS

BACKGROUND OF THE INVENTION

1. Field of the Invention

The present invention relates to a musical-tone-generating-control apparatus that controls the generation of musical-tone signals by delivering tone-pitch data to one of the musical-tone-signal-generating channels which constitutes a musical-tone-signal-generating circuit, and which also controls the tone-color of the musical-tone signals by supplying tone-color-control parameters stored in tone-color-parameter memory to the musical-tone-signal-generating .circuit 2. Prior Art A conventional apparatus of this type is described in the Japanese Patent Preliminary Publication No. sho 59-189394. It is provided with a plurality of musical-tone-signal-generating channels in a musical-tone-signal-generating circuit. Each channel is allocated to one of the tone groups such as a melody group, a chord group, a base group, etc., before performance. Once allocated, the allocation of channels is fixed during the performance, and tone-color data in every tone group is applied to a predetermined channel. For example, tone-pitch data relating to a melody part is supplied to the musical-tone-signal-generating channel allocated for melody; tone-pitch data relating to a chord part is transferred to the musical-tone-signal-generating channel for the chord, thus producing different tone colors depending on the tone group.

The conventional apparatus has a fixed and limited number of musical-tone-signal-generating channels for each tone group. This limits the maximum number of tones which can be generated in each tone group, and it causes the utilization efficiency of the musical-tone-signal-generating channels to decrease; even if there is a tone group with vacant channels, they cannot be used by the other groups. For example, when the number of musical tones belonging to the melody group exceeds the maximum number thereof, the melody group cannot handle some melody tones even if channels belonging to other groups are empty.

To counteract this disadvantage, it may be possible to supply tone-pitch data corresponding to musical tones to be generated, to each of the musical-tone-signal-generating channels, together with tone-color-control parameters for controlling the musical tone colors, so that the generation of musical-tone signal and the controlling of tone colors thereof are simultaneously performed at each channel.

The tone-color-control parameters used for generating each musical-tone signal, however, have increased recently in order to achieve high-quality musical tones. For this reason, if these numerous parameters must be transferred to the musical-tone-signal-generating channels every time tone-pitch data is applied thereto, the generation of musical-tone signals will be delayed because the transfer of these parameters requires much time, and this in turn retards other processes.

SUMMARY OF THE INVENTION

It is therefore an object of the invention to provide a musical-tone-generating-control apparatus that does not produce a long delay of musical-tone signals, and at the same time improves the efficiency of the musical-tone-signal generating channels.

According to one aspect of the present invention, there is provided a musical-tone-generating-control apparatus comprising:

musical-tone-signal-generating means having a plurality of musical-tone-signal-generating channels for generating musical-tone signals which controls the generation of musical-tone signals according to tone-pitch information supplied to each of the musical-tone-signal-generating channels, and controls tone colors of the musical-tone signals according to tone-color-control parameters;

tone-color-parameter-memory means for storing the tone-color-control parameters;

input means for entering primary information representing tone pitches of the musical-tone signals, and for entering secondary information representing tone colors of the musical-tone signals;

assigning means for selecting one of the musical-tone-signal-generating channels according to a predetermined rule, and for assigning the primary information to the selected musical-tone-signal-generating channel;

output means for supplying the assigned primary information to the musical-tone-signal-generating means to control generation of the musical-tone signal produced from the selected musical-tone-signal-generating channel according to the primary information, and for supplying the tone-color-control parameters corresponding to the secondary information in the tone-color- parameter-memory means to control tone colors of the musical-tone signals; and output inhibiting means for inhibiting output of the tone-color-control parameters to the musical-tone-signal-generating means when a tone color represented by the secondary information is the same as the tone color of the musical-tone signal previously generated in the selected musical-tone-signal-generating channel.

According to a more specific aspect of the invention, there is provided a musical-tone-generating-control apparatus further comprising:

The tone-color-information-storing means having a plurality of memory areas each of which corresponds to each of the musical-tone-signal-generating channels, updating tone-color information representing a tone color of the musical-tone signal generated in each of the musical-tone-signal-generating channels according to assignment of the primary information, and storing updated tone-color information to each of the memory areas; and priority-assigning-control means for controlling the assigning means so that the primary information is assigned to a musical-tone-signal-generating channel previously generating musical-tone signal of the same tone color as that of the secondary information.

DESCRIPTION OF THE PREFERRED EMBODIMENT

The invention will now be described with reference to the accompanying drawings.

Figure 1:
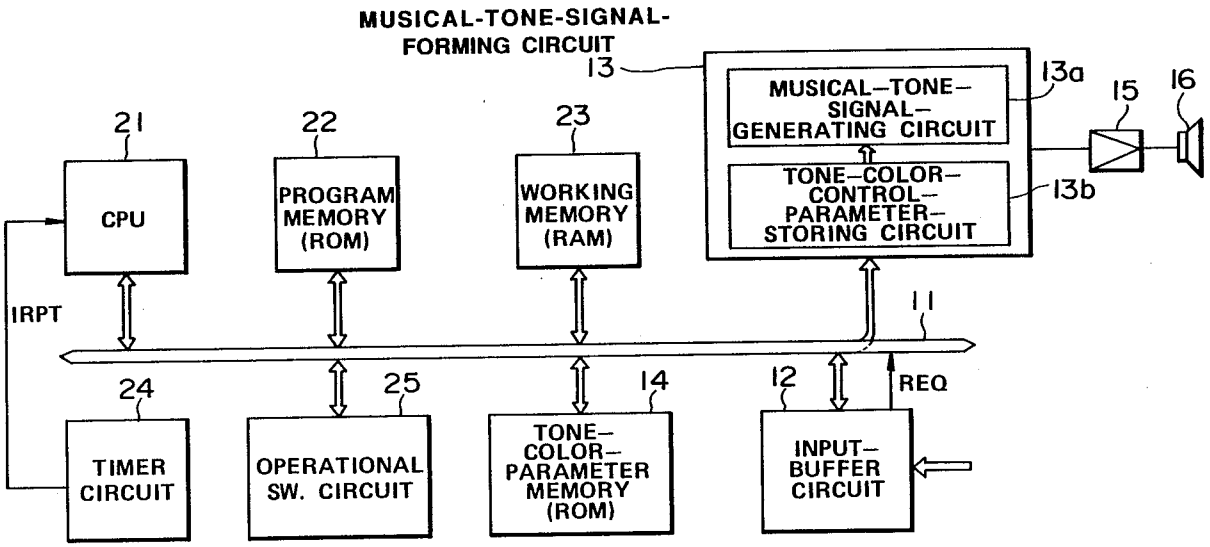
FIG. 1 is a block diagram of a musical-tone-signal-generating apparatus employing a musical-tone-generating-control apparatus according to an embodiment of the present invention.

FIG. 1 is a block diagram of a musical-tone-signal-generating apparatus employing a musical-tone-generating-control apparatus of the present invention.

The musical-tone-signal-generating apparatus comprises an input-buffer circuit 12, a musical-tone-signal-generating circuit 13, and tone-color-parameter memory 14, each of which is connected to a bus 11.

The input-buffer circuit 12 is connected to other apparatus such as an electronic musical instrument, or an automatic musical performance apparatus. This instrument or apparatus has an input device for a performance such as a keyboard, or performance data memory from which stored performance data are read sequentially, and supplies data relating to events to input-buffer circuit 12.

Figure 2:
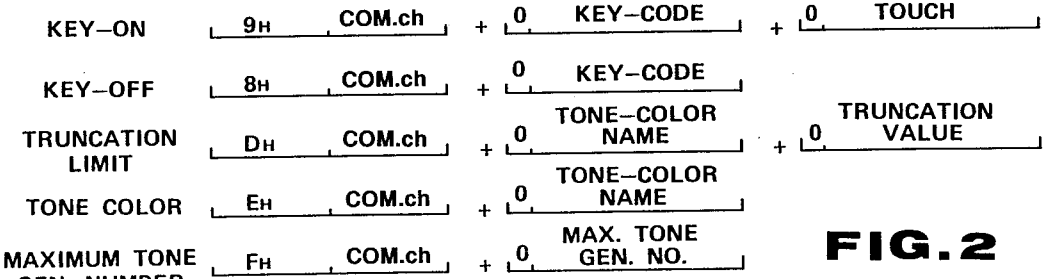
FIG. 2 is a diagram of the data format entered into an input-buffer circuit 12 shown in FIG. 1.

The input-buffer circuit 12, in turn, applies the data to bus 11 and places request signal REQ on bus 11 when the data is entered. These data are shown in FIG. 2 and will be described hereafter. A suffix H denotes hexadecimal notation, and a communication-channel number represents a musical part, for example, the first melody part, the second melody part, the first accompaniment part, the second accompaniment part, etc. Thus, tone-color data corresponding to each communication channel represents a tone color of each part. This means that a communication-channel number represents variable tone color of each part.

KEY-ON DATA

Key-on data consists of 3 bytes (1 byte is made up of 8 bits). The first byte is divided into two parts: the upper 4 bits and the lower 4 bits. The upper 4 bits contain discrimination code "$9_H$" indicating that the following data are associated with a key-on event, and the lower 4 bits represent a communication-channel number. The second byte contains key-code data that represents a tone pitch to be generated. The most significant bit MSB thereof is 0, and the lower 7 bits represent the tone pitch. The third byte represents the volume of the musical tone to be generated. The most significant bit MSB thereof is "0" and the lower 7 bits contain touch data that represents the volume.

KEY-OFF DATA

Key-off data consists of two bytes. The first byte is divided into two parts: the upper 4 bits and the lower 4 bits. The upper 4 bits contain discrimination code "$8_H$" indicating that the following data are associated with a key-on event, and the lower 4 bits represent a communication-channel number. The second byte contains key-code data that represents a tone pitch having been generated. The most significant bit MSB thereof is 0 and the lower 7 bits represent the tone pitch.

TRUNCATION-LIMIT DATA

Truncation-limit data consists of 3 bytes. The first byte is divided into two parts: the upper 4 bits and the lower 4 bits. The upper 4 bits contain discrimination code "$D_H$" indicating that the following data are truncation-limit data, and the lower 4 bits represent a communication-channel number. The second byte contains tone-color data that represents a tone color relating to the truncation-limit data. The most significant bit MSB thereof is 0 and the lower 7 bits represent the tone-color name. The third byte represents a truncation value. The most significant bit MSB thereof is "0" and the lower 7 bits contain the truncation value, which represents a level of the musical-tone-signal level at which the current musical-tone signal is eliminated to generate a new musical-tone signal.

TONE-COLOR DATA

Tone-color data consists of 2 bytes. The first byte is divided into two parts: the upper 4 bits and the lower 4 bits. The upper 4 bits contain discrimination code "$E_H$" which indicates that the following data are associated with tone color, and the lower 4 bits represent a communication-channel number. The second byte contains a tone-color name that represents a tone color of the communication channel. The most significant bit MSB thereof is 0 and the lower 7 bits represent the tone-color name.

MAXIMUM-TONE-GENERATING-NUMBER DATA

Maximum-tone-generating-number data consists of 2 bytes. The first byte is divided into two parts: the upper 4 bits and the lower 4 bits. The upper 4 bits contain discrimination code "$F_H$" indicating that the following data are associated with maximum-tone-generating-number data; and the lower 4 bits represent a communication-channel number. The second byte contains maximum-tone-generating-number data that represents a maximum number of musical tones relating to the communication channel. The most significant bit MSB thereof is 0 and the lower 7 bits represent the maximum number of ton generations associated with the communication channel.

The musical-tone-signal-generating circuit 13 comprises a musical-tone-signal-forming circuit **13*a* and a tone-color-control-parameter-storing circuit 13*b*. The musical-tone-signal-forming circuit 13*a* includes musical-tone-signal-forming channels, a musical-tone-control-data-storing circuit, etc.. The musical-tone-signal-forming channels consist of 12 channels in this embodiment, and each channel produces an independent musical-tone signal. The musical-tone-control-data-storing circuit, on the other hand, stores for each channel, a keycode KC that represents a tone pitch used for generating a musical-tone signal, key-on signal KON that represents on-states of the musical tone, and volume data VOL that indicates a volume of the musical tone of the channel. Tone-color-control-parameter-storing circuit 13*b* stores, for each musical-tone-signal-generating channel, a number of tone-color-control parameters used for controlling a tone color of the musical-tone signal. Outputs of musical-tone-signal-generating circuit 13 are supplied to speaker 16 via amplifier 15**.

Tone-color-parameter memory 14 is a ROM that stores, for each tone color, many tone-color-control parameters used for generating musical-tone signals of various tone colors.

Moreover, the musical-tone-signal-generating apparatus comprises CPU 21, program memory 22, working memory 23, and timer circuit 24. These components are connected to bus 11.

CPU 21 controls assignment of input data stored in input-buffer circuit 12 to the musical-tone-signal-generating channels, and also controls transfer of the assigned data as well as tone-color-control parameters stored in tone-parameter memory 14 to musical-tone-signal-generating circuit 13. Furthermore, CPU 21 initiates the main program corresponding to the flowchart shown in FIG. 3, when the power switch is turned on. It also executes a timer-interrupt program corresponding to a flowchart shown in FIG. 4 in synchronization with the timer-interrupt signal IRPT from timer circuit 24.

Figure 5:
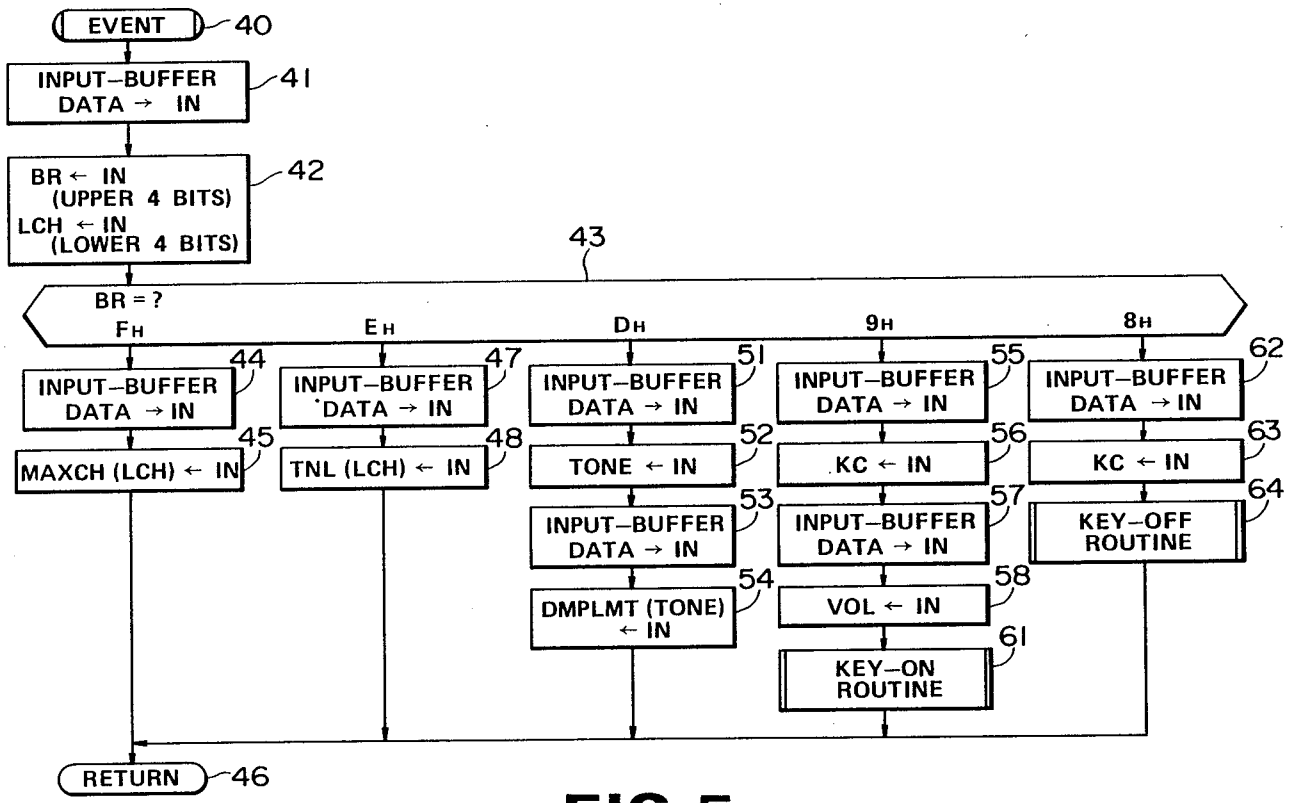
FIG. 5 is a flowchart of an event routine.
Figure 6A:
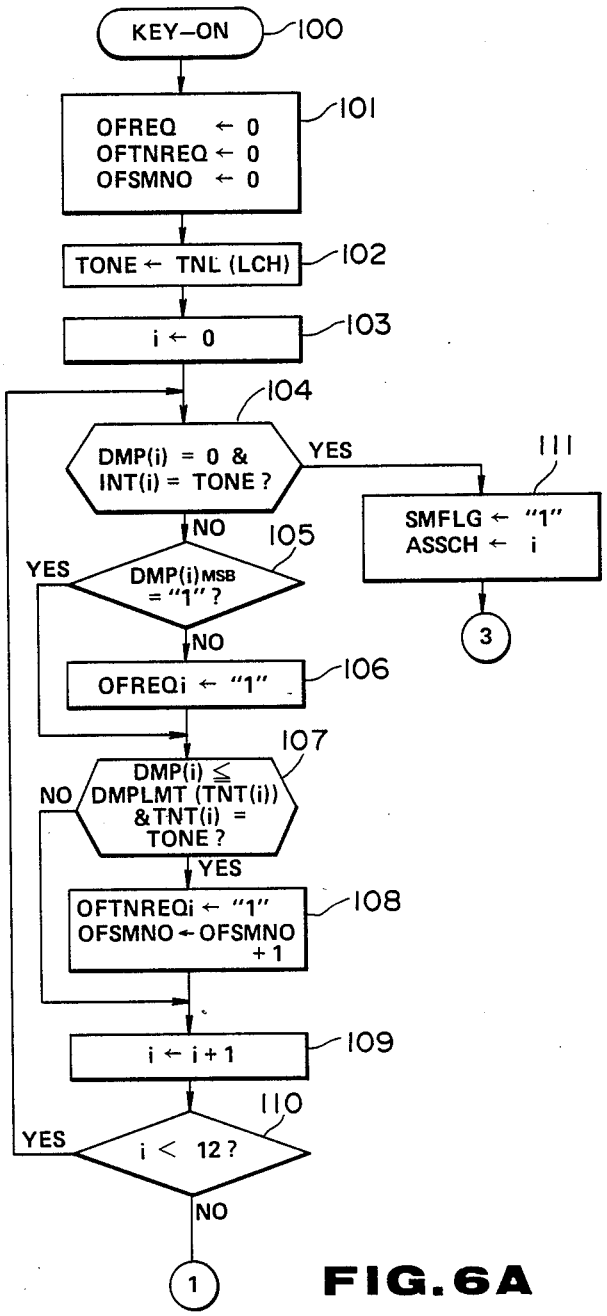
FIGS. 6A to 6C are flowcharts of a key-on routine.
Figure 6B:
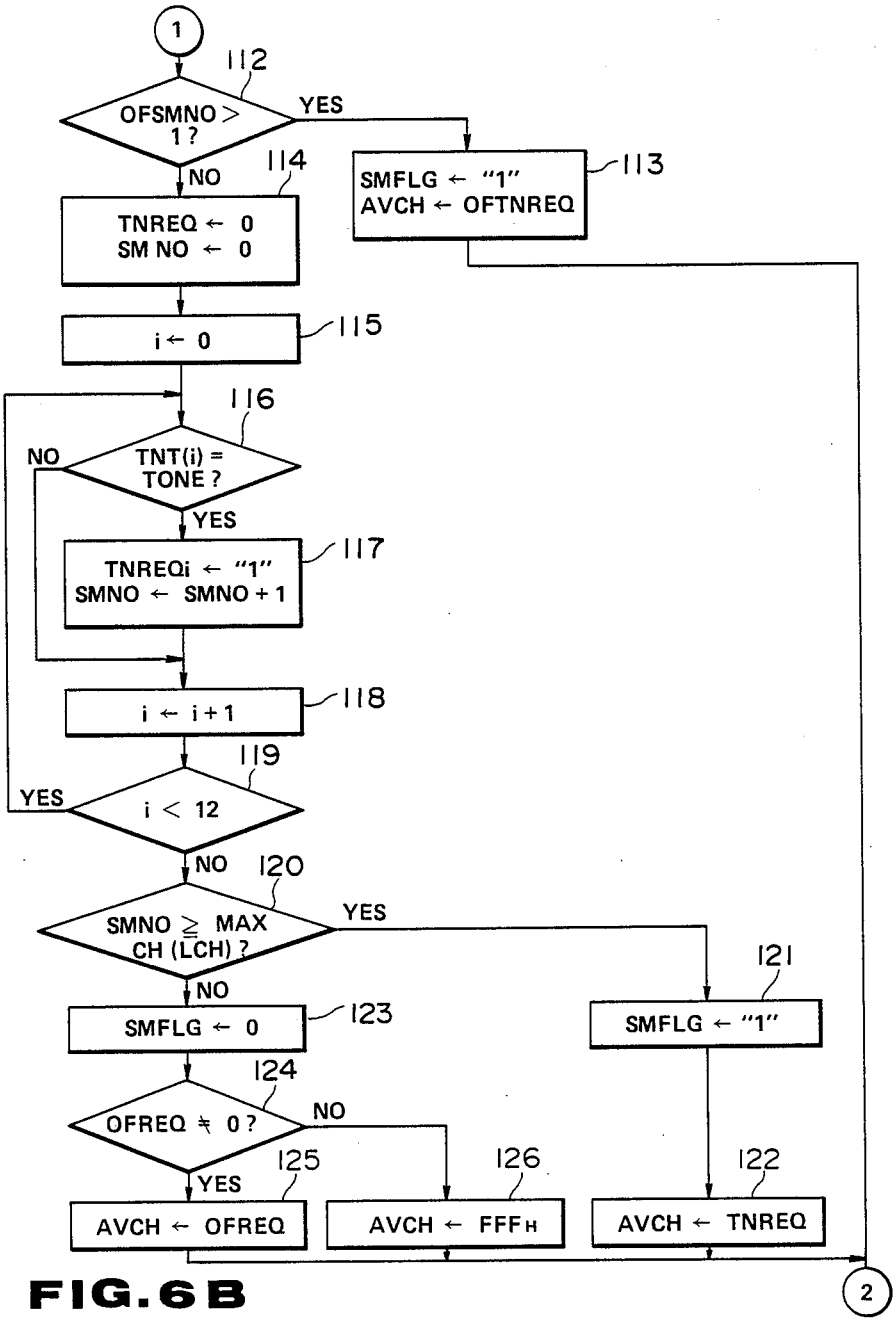
Figure 6C:
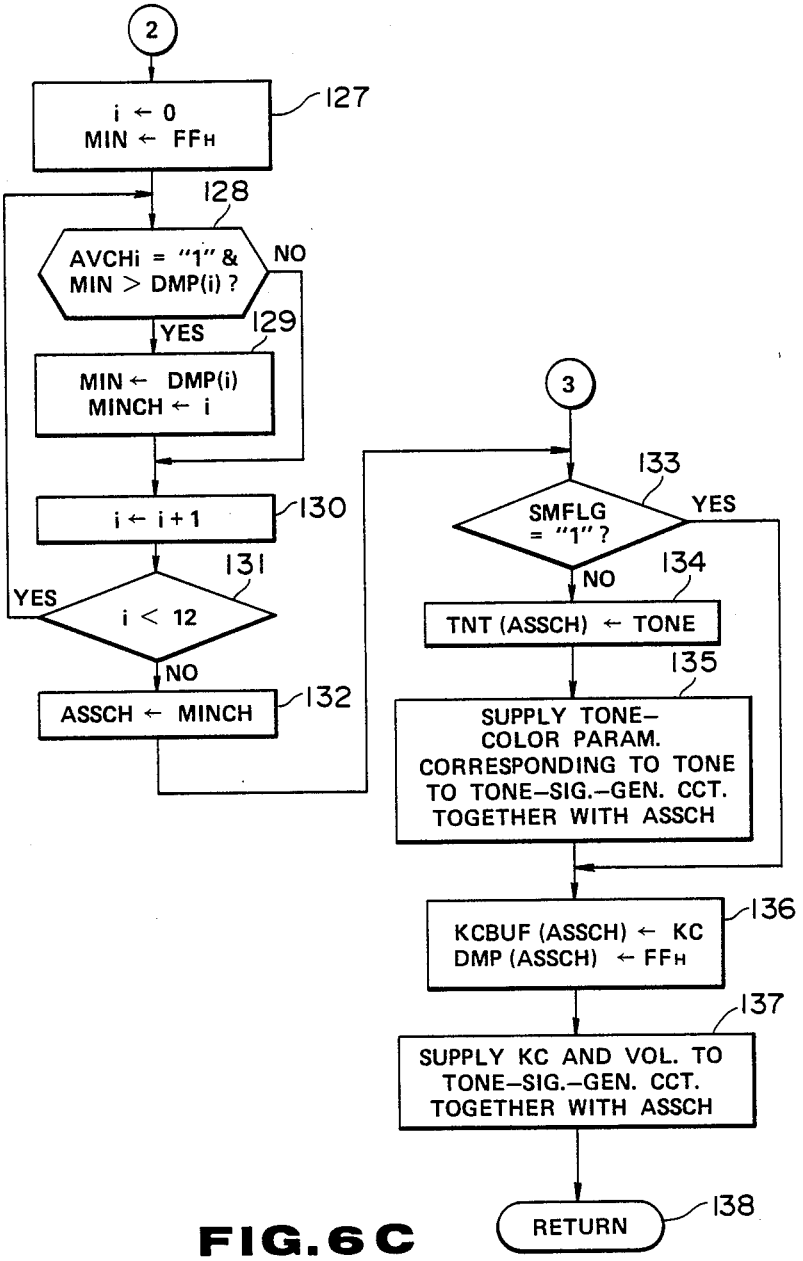
Figure 7:
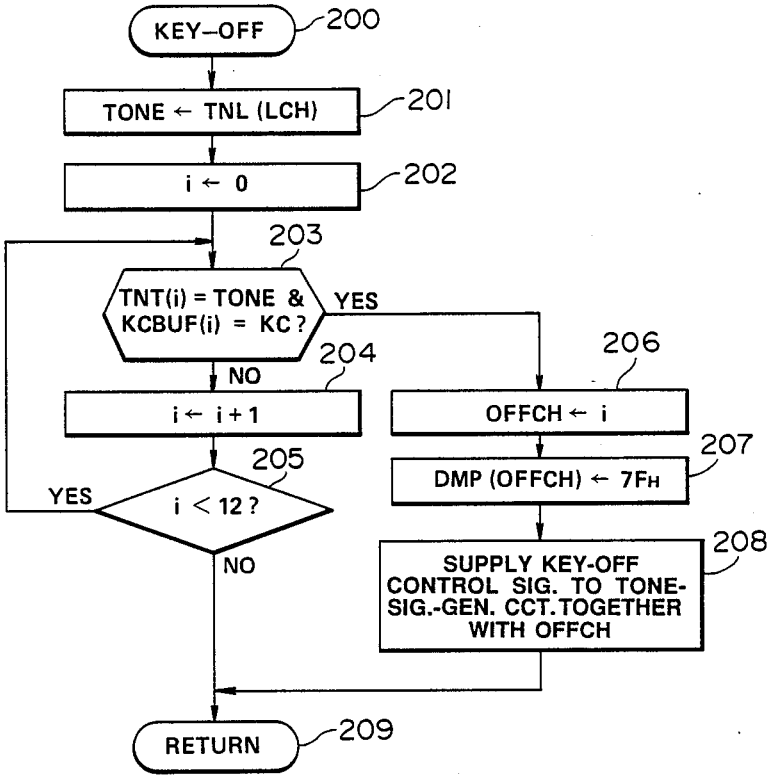
FIG. 7 is a flowchart of a key-off routine.

Program memory 22 is a ROM that stores various programs: the main program, the timer-interrupt program, and subroutine programs that correspond to flowcharts shown in FIG. 5 to FIG. 7. The timer-interrupt program and subroutine programs are used in the main programs. Working memory 23 is a RAM that temporarily stores various data used during the execution of programs. Timer circuit 24 produces timer-interrupt signals IRPT at a regular interval, e.g., from milliseconds to tens of milliseconds, and applies them to CPU 21.

Furthermore, the musical-tone-signal-generating apparatus has operational switch circuit 25 which is connected to bus 11, and is provided with switches for controlling the total volume, etc., of musical-tone signals generated by musical-tone-signal-generating circuit 13.

Next, the operation of the embodiment will be described in reference to flowcharts shown in FIG. 3 to FIG. 7.

Figure 3:
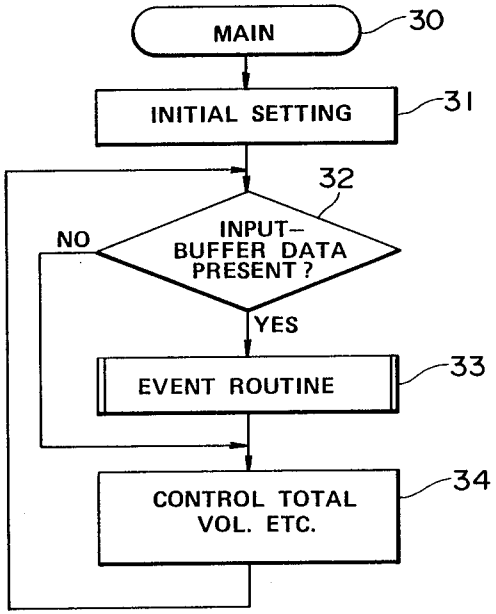
FIG. 3 is a flowchart of the main routine.

When the power switch is turned on, CPU 21 enters into the main program at step 30 in FIG. 3. At step 31, CPU 21 performs initial setting of data in working memory 23; it initializes at least dumping data DMP(0) to DMP(11), dumping-limit data DMPLMT(0) to DMPLMT(11), and tone-color data TNT(0) to TNT(11), each of which is provided for each of 12 musical-tone-signal-generating channels, and also initializes tone-color data TNL(0) to TNL(15), and maximum-tone-generating-number data MAXCH(0) to MAXCH(15), each of which is provided for each of 16 logical channels. The musical-tone-signal-generating channels are corresponding to 12 channels in musical-tone-signal-forming circuit 13*a*, whereas the logical channels corresponds to 16 communication channels of input data entered to the input-buffer circuit 12. In the initial setting, each datum is set to the following values:

DMP(0) to DMP(11)="0"
DMPLMT(0) to DMPLMT(11)="$7F_H$"
TNT(0) to TNT(11)="$FF_H$"
TNL(0) to TNL(15)="0"
MAXCH(0) to MAXCH(15)="12"

Meanings of the data mentioned above will be described later. Completing step 31, the CPU 21 proceeds to step 32 to determine if any data is entered to input-buffer circuit 12 by testing the presence or absence of the request signal REQ therefrom. If any data is entered to input-buffer circuit 12, CPU 21 executes event routine at step 33, and proceeds to step 34 where it controls the total volume of musical-tone signals in musical-tone-signal-generating circuit 13 according to detection result of switch operation in operational switch circuit 25. After that, CPU 21 repeats the loop from step 32 to step 34. In contrast, if no data is entered into input-buffer circuit 12, CPU 21 jumps to step 34 without executing event routine of step 33 repeating the loop from step 32 to 34.

The event routine mentioned above is shown in FIG. 5. The CPU 21 enters into the routine at step 40, and fetches the first byte in the input-buffer circuit 12 as input data IN, and eliminates the first byte from the circuit 12 at step 41. Completing step 41, CPU 21 stores the upper 4-bits (i.e., the discrimination code) of the input data IN as branch-control data BR, and the lower 4-bits thereof as logical channel data LCH that represents a logical channel corresponding to a communication channel in the musical-tone-signal-generating apparatus. At step 43, CPU 21 tests the branch-control data BR to execute processes according to the type of input data entered into input-buffer circuit 12.

Specifically, if the branch-control data BR is "$F_H$", which is the discrimination code of the maximum-tone-generating-number data, CPU 21 proceeds from step 43 to step 44 where it fetches the second byte (maximum-tone-generating number) in input-buffer circuit 12 as input data IN, and deletes the byte from circuit 12. Further, at step 45, CPU 21 sets the input data IN as the maximum-tone-generating-number data MAXCH(LCH) of the logical channel designated by the logical-channel data LCH. Thus, the maximum tone generating number of each part is set because the logical-channel data LCH (communication channel) represents each musical part. Completing step 45, CPU 21 exits the event routine at step 46.

If the branch-control data BR is "$E_H$", which is the discrimination code of the tone-color data, CPU 21 proceeds from step 43 to step 47 where it fetches the second byte (tone-color name) in input-buffer circuit 12 as input data IN, and deletes the byte from circuit 12. Furthermore, at step 48, CPU 21 sets the input data IN as the tone-color data TNL(LCH) of the logical channel designated by the logical-channel data LCH. Thus, the tone-color data for each logical channel (for each part) is set. Completing the step 48, CPU 21 exits the event routine at step 46.

If the branch-control data BR is "$D_H$", which is the discrimination code of the truncation-limit data, CPU 21 proceeds from step 43 to step 51 where it fetches the second byte (tone color name) in input-buffer circuit 12 as input data IN, with deleting the byte from circuit 12. Further, at step 52, CPU 21 temporarily stores the input data IN representing a tone color as tone data TONE. Subsequently, at step 53, CPU 21 fetches the third byte truncation value) in input-buffer circuit 12 as input data IN, and eliminates the byte from circuit 12. At step 54, CPU 21 sets the input data IN as the dumping-limit data DMPLMT(TONE) of the tone color designated by the tone data TONE. This means that the truncation value of each tone color is set as the dumping-limit data DMPLMT(TONE) because the input data IN represents a truncation value. Completing step 54, CPU 21 exits the event routine at step 46.

If the branch-control data BR is "$9_H$", which is the discrimination code of the key-on data, CPU 21 proceeds from step 43 to step 55 where it fetches the second byte (key-code of a depressed key) in input-buffer circuit 12 as input data IN, and deletes the byte from circuit 12. Further, at step 56, CPU 21 sets the input data IN representing a tone pitch as key-code KC. Subsequently, at step 57, CPU 21 fetches the third byte (touch data) in input-buffer circuit 12 as input data IN, and eliminates the byte from circuit 12. At step 58, CPU 21 sets the input data IN representing a volume as the volume data VOL, and proceeds to step 59 where it executes a key-on routine. Completing step 59, CPU 21 exits the event routine at step 46.

Finally, if the branch-control data BR is "$8_H$", which is the discrimination code of the key-on data, the CPU 21 proceeds from step 43 to step 62 where it fetches the second byte (key-code of a released key) in input-buffer circuit 12 as input data IN, and deletes the byte from circuit 12. Further, at step 63, CPU 21 sets the input data IN representing a tone pitch as key-code KC. Subsequently, CPU 21 executes a key-off routine at step 64. Completing step 64, CPU 21 exits the event routine at step 46.

Next, the key-on routine will be described. This routine allots a key-code KC to one of the musical-tone-signal-generating channels, and transfers data to musical-tone-signal-generating circuit 13, and so on. Before entering into the description thereof, assigning priority rules for allotting a key-code KC, and updating dumping data DMP of each musical-tone-signal-generating channel will be described. The updating is used to determine the priority of assigning key-codes to the channels, and to control the assigning operation.

ASSIGNING PRIORITY RULE (A)

The CPU 21 searches a musical-tone-signal-generating channel whose dumping data DMP indicates "0", and which had generated musical-tone signal of the same tone color as that of the musical-tone signal to be generated from that time on.

ASSIGNING PRIORITY RULE (8)

The CPU 21 searches a musical-tone-signal-generating channel which is generating a musical-tone signal of the same tone color as that of the musical-tone signal to be generated from that time on, and whose dumping data DMP is smaller than dumping-limit data DMPLMT, and is at the same time the minimum DMP data among channels generating the same tone color.

When there is no or only one musical-tone-signal-generating channel producing musical-tone signals of the same tone color, CPU 21 searches a new musical-tone-signal-generating channel as follows:

ASSIGNING PRIORITY RULE (C)

The CPU 21 searches a first released key channel; a musical-tone-signal-generating channel whose dumping data is a the minimum, and which is generating or has completed generation of a musical-tone signal of a released key, independently of a tone color of musical-tone signal to be generated from now on.

When the number of musical-tone-signal-generating channels which are generating musical-tone signals of the same tone color as that of musical-tone signal to be generated from now on, reaches the maximum number allowed for the tone colors (i.e., for the part), CPU 21 searches the musical-tone-signal-generating channel whose dumping data is the minimum among the musical-tone-signal-generating channels producing the same tone color.

ASSIGNING PRIORITY RULE (D)

The CPU 21 searches a first depressed key channel, a musical-tone-signal generating channel whose dumping data is a the minimum, independently of the tone color of musical-tone signal to be generated from that time on, and of a state whether a musicaltone signal associated with a released key is being generated or not.

When the number of musical-tone-signal-generating channels which are generating musical-tone signals of the same tone color as that of musical-tone signal to be generated from now on, reaches the maximum number of the tone colors, CPU 21 searches the musical-tone-signal-generating channel whose dumping data is the minimum among the musical-tone-signal-generating channels producing the same tone color.

UPDATING DUMPING DATA DMP

Figure 4:
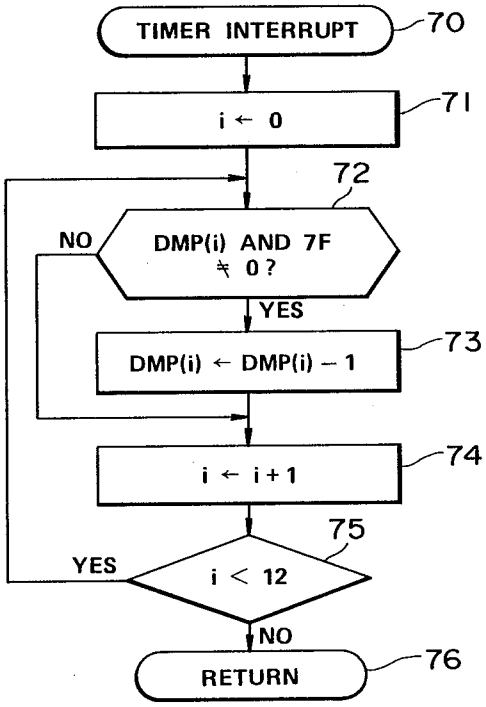
FIG. 4 is a flowchart of a timer-interrupt routine.

The CPU 21 enters into the timer interrupt routine shown in FIG. 4, each time the timer interrupt signal IRPT produced by timer circuit 24 is applied to CPU 21. CPU 21 initiates the routine at step 70, performs the initial setting of variable i (i=0) at step 71, and updates each dumping data DMP(0) to DMP(11) of 12 musical-tone-signal-generating channels at steps 72 and 73, with updating the variable i (i+1→i) from "0" to "11" by comparing it with a constant "12" (i<12) at steps 74 and 75.

Specifically, at step 72, CPU 21 separates the lower 7 bits of each dumping data DMP(0) to DMP(11) by ANDing DMP(i) and $7F_H$, and determines whether the separated data is "0" or not. If it is not 0 ("YES"), CPU 21 proceeds to step 73 and decrements each dumping data DMP(0) to DMP(11) by 1, by computing DMP(i)=DMP(i)−1. On the other hand, when the separated data is 0 ("NO"), CPU 21 proceeds to step 74 without changing dumping data DMP(0) to DMP(11).

Each dumping data DMP(i) is initially set to "$FF_H$" when a keycode is assigned to channel i on a key depression, which will be described later. Hence, when the musical-tone signals of depressed keys are generated, each dumping data DMP(0) to DMP(11) is decremented by 1 from "$FF_H$" to "$80_H$" each time the timer interrupt signal IRPT occurs, through the loop from step 72 to 75. On the other hand, when a key associated with channel i is released, dumping data DMP(i) is initially set to "$7F_H$" at key release timing. Thus, when the musical-tone signals of released keys are generated, each dumping data DMP(0) to DMP(11) is decremented by 1 from "$7F_H$" to "$00_H$" each time the timer interrupt signal IRPT occurs, through the loop from step 72 to 75.

When CPU 21 updates all the dumping data DMP(0) to DMP(11) by running the loop from step 72 to 75, the variable i reaches "12", and a test result of step 75 changes to "NO". Thus, the timer interrupt routine is finished, and CPU 21 returns to the main program in FIG. 3.

FIGS. 6A to 6C are flowcharts of the key-on routine, which assigns key-codes KC to musical-tone-signal-generating channels, and transfers data to musical-tone-signal-generating circuit 13. CPU 21 enters into the routine at step 100, and initializes all the bits of off-channel data OFREQ and identical-tone-color-off-channel data OFTNREQ to 0, as well as initializes identical-tone-color-off-channel-number data OFSMNO to 0 at step 101. Each of the off-channel data OFREQ and identical-tone-color-off-channel data OFTNREQ consists of 12-bit data corresponding to 12 musical-tone-signal-generating channels. Each bit of off-channel data OFREQ and identical-tone-color-off-channel data OFTNREQ indicates a state of each musical-tone-signal-generating channel: each bit of off-channel data OFREQ represents by "1" that the channel is associated with a released key, and by "0" that the channel is associated with a non-released (depressed) key; each bit of identical-tone-color-off-channel data OFTNREQ represents by "1" that the channel is associated with a released key which is generating or has generated a musical-tone signal of the same tone color as that of a musical-tone signal generated by a new key-depression, and represents by "0" that the channel is in the other state. Additionally, identical-tone-color-off-channel-number data OFSMNO represents the number of channels associated with released keys which are generating or have generated musical-tone signals of the same tone color as that of a musical-tone signal generated by a new key-depression. The number indicated by OFSMN is equal to the number of "1" bits in identical-tone-color-off-channel data OFTNREQ.

Completing the initial setting at step 101, CPU 21 proceeds to step 102, and temporarily stores tone-color data TNL(LCH) as tone data TONE. The tone-color data TNL(LCH) is designated by a logical channel LCH in key-on data, and represents a tone color of a musical part to which the key-code KC belongs. At step 103, CPU 21 sets the variable i to 0. At step 104, CPU 21 searches a musical-tone-signal-generating channel i whose dumping data DMP(i) indicates "0" (DMP(i)=0), and whose tone-color data TNT(i) is the same as tone color TONE of the musical-tone signal to be generated from then on (TNT(i)=TONE). This corresponds to assigning priority rule (A) described above.

From step 105 to 108, CPU 21 searches a musical-tone-signal-generating channel whose dumping data DMP(i) is smaller than the dumping-limit data DMPLMT(TNT(i)) specified for each tone color, and which is generating or has generated a musical-tone signal of the same tone color as that of the musical-tone signal to be generated according to a new key depression (this corresponds to parts of assigning priority (B) and (C) described above). These steps 104 to 108 are carried out with steps 109 and 110 where CPU 21 increments the variable i by 1 (i+1→i), and compares a value of i with 12, until it reaches 12.

When CPU 21 searches a channel that satisfies assigning priority rule (A), i.e., DMP(i)="0" and simultaneously TNT(i)=TONE, at step 104 in the loop from step 104 to 110, a test result at step 104 will be "YES". Hence, CPU 21 proceeds to step 111 where it sets identical-tone-color flag SMFLG to "1", and also sets assigning-channel data ASSCH to value i that indicates the channel satisfying the condition of step 104. Here, tone-color data TNT(i) represents a tone color of the musical-tone signal generated in the musical-tone-signal-generating channel i, assigning-channel data ASSCH represents a musical-tone-signal-generating channel to which a key-code KC of a new depressed key is assigned, and identical-tone-color flag SMFLG (="1") indicates that a tone color of the channel is to be maintained.

After step 111, CPU 21 proceeds to step 133 is in FIG. 6C, and tests whether identical-tone-color flag SMFLG is "1" or not. In this case, since the flag SMFLG is set to "1" as described above, the test result at step 133 is "YES". Hence, CPU 21 proceeds to step 136, and sets a new key-code KC as key-code-buffer data KCBUF(ASSCH) designated by assigning-channel data ASSCH, as well as initializes dumping data DMP(ASSCH) to "$FF_H$". The key-code-buffer data KCBUF(ASSCH) corresponds to each of 12 musical-tone-signal-generating channels, and represents the key-code assigned to each channel. Thus, the new key-code KC is assigned to a musical-tone-signal-generating channel according to assigning priority rule (A). Subsequently, CPU 21 proceeds to step 137, and supplies the new key-code KC, volume data VOL (i.e., touch data) entered with the key-code KC, and assigning-channel data ASSCH to musical-tone-signal-generating circuit 13.

Receiving these data, musical-tone-signal-forming circuit 13*a* in musical-tone-signal-generating circuit 13, stores key-code KC and volume data VOL to memory location which is provided, for each channel, in the musical-tone-control-data-storing circuit, and is designated by assigning-channel data ASSCH. The circuit 13*a* also sets "1" to key-on signal KON corresponding to the assigning-channel data ASSCH in the musical-tone-control-data-storing circuit.

As will be described later, in a memory location designated by assigning-channel data ASSCH in tone-color-control-parameter-storing circuit 13*b*, a tone-color-control parameter previously supplied thereto is stored. In this case, the tone-color-control parameter is the same as that of the musical-tone signal to be generated according to the new key-code KC. Consequently, musical-tone-signal-forming circuit 13*a* forms a musical-tone signal having a tone pitch corresponding to the new key-code KC, and having a tone color determined by the tone-color-control parameter. Moreover, the circuit 13*a* controls a volume of the musical-tone signal according to volume data VOL and supplies the signal to speaker 16 via amplifier 15. As a result, a musical tone corresponding to the musical-tone signal is produced from speaker 16. Completing step 137, CPU 21 exits the key-on routine at step 138.

When no channel satisfies assigning priority rule (A) in the loop from step 104 to 110 in FIG. 6A, CPU 21 determines at step 105 whether the most significant bit MSB of dumping data DMP(i) is "1" or not ($DMP(i)_{MSB}$="1"). This is equivalent to determining whether the key associated with the dumping data DMP(i) is being depressed or released, because dumping data DMP(i) varies, as described before, from "$FF_H$" to "$80_H$" when a key associated therewith is depressed, whereas dumping data DMP(i) varies from "$7F_H$" to "$00_H$" when the key is released, and hence, the most significant bit MSB of dumping data DMP(i) remains at "1" only during the key depression.

When the key is being depressed, i.e., when the test result at step 105 is "YES", CPU 21 proceeds to step 107, with the bit designated by variable i in off-channel data OFREQ maintaining "0" as set at step 101. In contrast, when the key is released, the test result at step 105 is "NO". In this case, CPU 21 proceeds to step 106, and makes the bit designated by variable i in off-channel data OFREQ "1" (OFREQi="1"). Thus, in off-channel data OFREQ, each bit corresponding to a musical-tone-signal-generating channel associated with a released key is set to "1".

In a similar manner, in identical-tone-color-off-channel data OFTNREQ, each bit corresponding to a channel whose tone color is the same as that of a musical-tone signal to be generated from now on, and whose dumping data DMP(i) is less than the dumping-limit data DMp(TNT(i)), is set to "1". In addition, the channel number that satisfies these conditions is set as identical-tone-color-off-channel-number data OFSMNO.

More specifically, at step 107, CPU 21 tests and determines if the following two items are satisfied simultaneously: whether dumping data DMP(i) is less than the dumping-limit data DMP(TNT(i)); and whether musical-tone-signal-generating channel i has generated a musical-tone signal of the same tone color as that of the musical-tone signal to be generated from now on (this corresponds to DMP(i)≦DMPLMT(TNT(i)) AND TNT(i)=TONE). When these conditions are satisfied, the test result at step 107 is "YES", and CPU 21 proceeds to step 108. At step 108, CPU 21 sets "1" to the bit designated by variable i in identical-tone-color-off-channel data OFTNREQ (OFTNREQi="1"), and increments identical-tone-color-off-channel-number data OFSMNO by 1 (OFSMNO=OFSMNO+1). In contrast, when the test result at step 107 is "NO", CPU 21 proceeds to step 109, without performing the process of step 108. In this case, the bit corresponding to variable i in identical-tone-color-off-channel data OFTNREQ is maintained "0" as set at step 101, and identical-tone-color-off-channel-number data OFSMNO is also sustained to a previous value.

Completing the loop from step 104 to 110 with variable i="12" at step 110, i.e., without finding a channel that satisfies assigning priority rule (A), the program proceeds to step 112 according to the test result of "NO" at step 110.

At step 112, CPU 21 tests whether identical-tone-color-off-channel-number data OFSMNO is greater than "1". The test corresponds to the latter part of assigning priority rule (B), i.e., when there is only one or no musical-tone-signal-generating channel which is generating musical-tone signal of the same tone color as that of the musical-tone signal to be generated from now on, and whose dumping data DMP is smaller than the dumping-limit data DMPLMT, CPU 21 searches a new musical-tone-signal-generating channel according to assigning priority rules (C) and (D). If identical-tone-color-off-channel-number data OFSMNO is greater than "1", that is, if the test result at step 112 is "YES", CPU 21 proceeds to step 113 where it sets "1" to identical-tone-color flag SMFLG, and also sets identical-tone-color-off-channel data OFTNREQ to available channel data AVCH. The available channel data AVCH consists of 12 bits, each of which corresponds to each channel of 12 musical-tone-signal-generating channels, as each bit in off-channel data OFREQ and identical-tone-color-off-channel data OFTNREQ. Each bit in available data AVCH represents the state of each corresponding channel: "1" represents an available channel, whereas "0" indicates an unavailable channel. Available data AVCH is used in searching process for assigning channel carried out in the loop from step 127 to 131.

The loop from step 128 to 131 is performed after steps 113 and 127. At step 127, CPU 21 initializes the variable i to 0 (i=0) and minimum data MIN for searching a minimum value of dumping data DMP(i) to its initial value (MIN=$FF_H$). At steps 128 and 129, it searches the channel whose dumping data DMP(i) is minimum among the available channels. This is performed by incrementing variable i (i+1→i) at step 130, changing its value from "0" to "12" by comparing i with a constant of 12 (i<12) at step 131.

More specifically, if the bit data designated by variable i in available channel data AVCH is "1", and the minimum data MIN is larger than dumping data DMP(i) designated by variable i, i.e., AVCHi="1" AND MIN>DMP(i), the test result at step 128 is "YES". In this case CPU 21 proceeds to step 129 where it updates the minimum data MIN to the dumping data DMP(i), and also updates the minimum-channel-number data MINCH to i that indicates the channel number storing the dumping data DMP(i). In contrast, if the test result at step 128 is "NO", CPU 21 jumps to step 130 without performing step 129. Thus, when variable i reaches "12", and the test result at step 131 becomes "NO", minimum-channel-number data MINCH designates a channel number that satisfies assigning priority rule (B): selecting a musical-tone-signal-generating channel i which is generating musical-tone signal of the same tone color as that of the musical-tone signal to be generated from now on, and whose dumping data DMP(i) is smaller than the dumping-limit data DMPLMT, and at the same time is minimum.

Completing the loop from step 128 to 131, CPU 21 sets the minimum-channel-number data MINCH to assigning-channel data ASSCH at step 132, and also sets the key-code KC entered into input-buffer circuit 12 to key-code-buffer data KCBUF(ASSCH) designated by assigning-channel data ASSCH at step 136 shown in FIG. 6C. Thus, the new key-code KC is assigned to the musical-tone-signal-generating channel according to assigning priority rule (B).

Completing step 132, CPU 21 proceeds to step 133 and tests identical-tone-color flag SMFLG. Because the current flag SMFLG is "1", the test result at step 133 is "YES", and CPU 21 proceeds to steps 136 and 137 where the generation of musical-tone signals is controlled in a similar manner as described above. In this case, the tone-color-control parameters are not supplied to musical-tone-signal-generating circuit 13.

Next, the operation when two or more musical-tone-signal-generating channels satisfying assigning priority rules (A) and (B) are not found, will be described. In this case, the test result at step 112 is "NO", and a new key-code KC is assigned to the musical-tone-signal-generating channel selected according to the latter part of assigning priority rules (C) and (D): when the number of musical-tone-signal-generating channels which are generating musical-tone signals of the same tone color as that of musical-tone signal to be generated from then on (i.e., identical-tone-color-channel-number data SMNO), reaches the maximum number of tone color (i.e., MAXCH(LCH)), CPU 21 searches for the musical-tone-signal-generating channel whose dumping data is the minimum among the musical-tone-signal-generating channels producing the same musical tone.

When the test result at step 112 is "NO", CPU 21 proceeds to step 114 where it initializes all the bits in identical-tone-color-channel data TNREQ to 0, and also initializes identical-tone-color-channel-number data SMNO to 0. The identical-tone-color-channel data TNREQ consists of 12 bits, each of which corresponds to each of 12 musical-tone-signal-generating channels, as in off-channel data OFREQ and identical-tone-color-off-channel data OFTNREQ, and represents the state of each channel: a bit of "1" indicates that the channel corresponding thereto is generating a musical-tone signal of the same tone color as that of the musical-tone signal to be generated by a new key depression independent of the state of whether a key associated with the channel is released or not; a bit of "0" represents the other state of the channel. The identical-tone-color-channel-number data SMNO, in contrast, represents the number of channels generating musical-tone signals of the same tone color as that of the musical-tone signal to be generated by a new key depression independently of the state whether keys associated with th channels are released or not. The number of channels is equal to that of bits of "1" in identical-tone-color-channel data TNREQ.

Completing the initial setting at step 114, CPU 21 initializes a variable i to 0 (i=0) at step 115, and proceeds to step 116. At step 116, CPU 21 tests whether a tone color of a musical-tone signal previously generated from the channel designated by variable i (TNT(i)) is the same as that of a musical-tone signal to be generated from then on (TONE), which is represented as TNT(i)=TONE. If the test result is "YES" CPU 21 proceeds to step 117 where it sets a bit designated by variable i in identical-tone-color-channel data TNREQ to "1" (TNREQi="1") as well as increments identical-tone-color-channel-number data SMNO by 1 (SMNO=SMNO+1). In contrast, if the test result at step 16 is "NO", CPU 21 jumps to step 118 without performing step 117, thus maintaining the bit corresponding to variable i in identical-tone-color-channel data TNREQ to "0" as was set at step 114, and simultaneously maintaining identical-tone-color-channel-number data SMNO to a previous value. As a result, each bit in identical-tone-color-channel data TNREQ corresponding to a channel generating musical-tone signals of the same tone color as that of a musical-tone signal to be generated from then on, is set to "1", and simultaneously the number of channels that satisfy this condition is set as identical-tone-color-channel-number data SMNO.

CPU 21 performs these steps 116 and 117 with step 118 that increments variable i by 1 (i=i+1), and with step 119 that compares i with the constant 12 (i<12), thus varying the variable i from "0" to "12". When the variable i reaches "12" and test result at step 119 presents "NO", CPU 21 exits the loop for searching identical-tone-color channels from step 116 to step 119, and proceeds to step 120.

At step 120, CPU 21 tests whether the value of identical-tone-color-channel-number data SMNO is greater than or equal to that of maximum-tone-generating-number data MAXCH(LCH) which is designated by the logical-channel data LCH corresponding to the communication channel in key-on data entered, and is set at step 45 (i.e., SMNO≧MAXCH(LCH)). If identical-tone-color-channel-number data SMNO reaches maximum-tone-generating-number data MAXCH(LCH) available for the musical part to which a new key-code belongs, the test result at step 120 is "YES". In this case, CPU 21 sets "1" to identical-tone-color flag SMFLG at step 121, and also sets identical-tone-color-channel data TNREQ to the available-channel data AVCH at step 122. Subsequently, CPU 21 proceeds to step 127 to search the minimum value of dumping data DMP(i) through steps 127 to 131 (in this case, the minimum value among the identical-tone-color channels is searched). At steps 132 and 136, CPU 21 sets the assigning-channel data ASSCH and key-code-buffer data KCBUF(ASSCH). Thus, the new key-code KC is assigned to the musical-tone-signal-generating channel selected according to assigning priority rules (C) and (D). Completing step 132, CPU 21 proceeds to step 133 and tests identical-tone-color flag SMFLG. As the current flag SMFLG is "1", the test result at step 133 is "YES", and CPU 21 proceeds to steps 136 and 137 where generation of musical-tone signals is controlled in a similar manner as described above. In this case, the tone-color-control parameters are not supplied to musical-tone-signal-generating circuit 13

In contrast, if the test result at step 120 is "NO", i.e., if the value of identical-tone-color-channel-number data SMNO is smaller than the maximum-tone-generating-number data MAXCH(LCH), the new key-code KC is assigned to the musical-tone-signal-generating channel selected according to assigning priority rule (C) described above: CPU 21 assigns the new key-code to the first released channel, i.e., a musical-tone-signal-generating channel whose dumping data is the minimum, and which is generating or has completed generation of a musical tone of a released key, independently of a tone color of musical-tone signal to be generated from then on. In this case, at step 123, CPU 21 sets identical-tone-color flag SMFLG to "0", and tests whether all bits of the off-channel data OFREQ are 0 or not (OFREQ not=0) at step 124. If one or more bits of the off-channel data OFREQ are "1", the test result at step 124 is "YES", and available channel data AVCH is updated to the off-channel data OFREQ at step 125. Subsequently, CPU 21 proceeds to step 127 to search the minimum value of dumping data DMP(i) through steps 127 to 131 (in this case, the minimum value among the channels associated with released keys is searched). At steps 132 and 136, CPU 21 sets the assigning-channel data ASSCH and key-code-buffer data KCBUF(ASSCH). Thus, the new key-code KC is assigned to the musical-tone-signal-generating channel selected according to assigning priority rule (C).

Setting the minimum-channel-number data MINCH to assigning-channel data ASSCH at step 132, CPU 21 proceeds to step 133 (FIG. 6C), and tests identical-tone-color flag SMFLG. Since the identical-tone-color flag SMFLG is "0" in this case, the test result at step 133 is "NO", and CPU 21 proceeds to step 134. At step 134, tone-color data TNT(ASSCH) of the musical-tone-signal-generating channel designated by assigning-channel data ASSCH is updated to the tone data TONE representing the new tone color. Completing step 134, CPU 21 reads tone-color-control parameters of a tone color designated by the tone-color data TONE from tone-color-parameter memory 14 at step 135 and supplies the tone-color-control parameters to musical-tone-signal-generating circuit 13 together with the assigning-channel data ASSCH Receiving these tone-color-control parameters and assigning-channel data ASSCH, musical-tone-control-parameter-storing circuit **13*b* in musical-tone-signal-generating circuit 13 stores the tone-color-control parameters to memory locations designated by the assigning-channel data ASSCH. The musical-tone-signal-forming circuit 13*a* forms a musical-tone signal of the channel corresponding to the assigning-channel data ASSCH, and the tone color thereof is controlled by storing circuit 13*b* by use of the stored tone-color-control parameters. Hence, musical-tone-signal-generating circuit 13** produces musical-tone signal designated by the tone-color-control parameters from the assigned channel.

If the test result at step 124 is "NO", i.e., if all the bits in off-channel data OFREQ are "0" because there is no channel indicating a released key, a new key-code KC is assigned to the musical-tone-signal-generating channel selected according to assigning priority rule (D) described above: CPU 21 assigns a new key-code to a first depressed channel, i.e., a musical-tone-signal generating channel whose dumping data is the minimum independently of a tone color of musical-tone signal to be generated from now on, and of a state whether musical-tone signal associated with a released key is being generated or not.

In this case, available-channel data AVCH is set to "$FFF_H$" at step 126. As a result, all bits in available-channel data AVCH are set to "1". This means that a key-code can be assigned to any of 12 channels. Subsequently, CPU 21 proceeds to step 127 to search for the minimum value of dumping data DMP(i) through steps 127 to 131 (in this case, the minimum value among all the channels is searched). At steps 132 and 136, CPU 21 sets the assigning-channel data ASSCH and key-code-buffer data KCBUF(ASSCH). Thus, the new key-code KC is assigned to the musical-tone-signal-generating channel selected according to assigning priority rule (D).

Completing step 132, CPU 21 proceeds to step 133 (FIG. 6C), and tests identical-tone-color flag SMFLG. Since the identical-tonecolor flag SMFLG is also "0" in this case, the test result at step 133 is "NO", and CPU 21 proceeds to step 134 where tone-color data TNT(ASSCH) is updated to the tone data TONE representing the new tone color. At step 135, tone-color-control parameters corresponding to assigning-channel data ASSCH in musical-tone-signal-generating circuit 13 are updated. As a result, musical-tone-signal-generating circuit 13 produces a musical-tone signal designated by the tone-color-control parameters from the assigned channel.

As described above, when a new key-on data is entered into input-buffer circuit 12, the key-code KC, together with tone data TONE (tone-color information) associated with the key-code KC, is assigned to one of musical-tone-signal-generating channel from step 100 to 132 (FIG. 6A to 6C), and at steps 134 and 136 (FIG. 6C). As a result, tone pitch and tone color of a musical-tone signal are simultaneously controlled, which reduces limits that restrict the number of musical-tone-signal-generating channels available for each part (communication channel). These key-code KC and tone data TONE (tone-color information) are preferentially assigned to a musical-tone-signal-generating channel whose tone color is not altered by the tone data TONE, i.e., whose tone color is identical to that of a musical-tone signal to be generated from then on, according to assigning priority rules (A) to (D). In this case, the assigned channel necessitates no change in musical-tone-control parameters, and so output thereof to musical-tone-signal-generating circuit 13 is inhibited at steps 133 to 135. As a result, time for transferring tone-color-control parameters is saved and so the other programs are more quickly performed. FIG. 7 is a flowchart of the key-off routine executed at step 64 in FIG. 5. CPU 21 enters into the routine at step 200, and temporarily stores tone-color data TNL(LCH) as tone data TONE at step 201. The tone-color data TNL(LCH) is designated by a logical channel LCH (which is set at step 42 in FIG. 5) associated with key-off data, and represents a tone color of a musical part to which a key-code of a released key belongs. At step 202, CPU 21 initializes the variable i to 0 (i=0). At step 203, CPU 21 searches and determines a musical-tone-signal-generating channel which is generating a musical-tone signal of a released key, i.e., a musical-tone signal associated with a key-code KC entered. This is performed by searching a musical-tone-signal-generating channel having the same tone color as that of the key-off data entered, i.e., a channel in the same part and storing the same key-code KC (TNT(i)=TONE AND KCBUF(i)=KC). In this case, not only key-code KC but also tone-color TNT(i) is tested because i may be possible that musical-tone signals of the same pitch are occurring simultaneously if tone-colors are different.

The step 203 is carried out with steps 204 and 205 where CPU 21 increments the-variable i by 1 (i+1→i), and compares a value of i with 12, until it reaches 12, thus varying the variable i from "0" to "11" (i<12).

When CPU 21 searches a musical-tone-signal-generating channel generating the musical-tone signal of a released key in the loop from step 203 to 205, a test result at step 203 will be "YES". Hence, CPU 21 proceeds to step 206 and sets the variable i to off-channel data OFFCH that represents a channel associated with a released key. Additionally, at step 207, CPU 21 sets "$7F_H$" to dumping data DMP(OFFCH) of the channel designated by the off-channel data OFFCH. This makes dumping data DMP(i), which has stopped updating at the value of "$80_H$", start again to decrement by 1 beginning from "$7F_H$" on the key release. Completing step 207, CPU 21 supplies off-channel data OFFCH and key-off-control signal to musical-tone-signal-generating circuit 13 at step 208, and completes the key-off routine at step 209.

The musical-tone-signal-forming circuit 13*a* in musical-tone-signal-generating circuit 13 sets "0" to the key-on signal of the musical-tone-signal-generating channel designated by the off-channel data OFFCH, according to the key-off-control signal and off-channel data OFFCH, and terminates the generation of musical-tone signal of the channel.

Although a specific embodiment of a musical tone control apparatus constructed in accordance with the present invention has been disclosed, it is not intended that the invention be restricted to either the specific configurations or the uses disclosed herein. For example, modifications may be made in a manner obvious to those skilled in the art as follows:

(1) CPU 21 in the above embodiment searches a musical-tone-signal-generating channel which is generating a musical-tone signal of the same tone-color to that of a musical-tone signal to be generated from then on, and whose dumping data DMP is smaller than the dumping-limit data DMPLMT. Furthermore, CPU 21 counts the number of these channels, stores the number as identical-tone-color-off-channel-number data OFSMNO, and tests whether the number, i.e., the data OFSMNO is greater than "1" at step 112. If the data OFSMNO is one or less, a new key-code KC is not assigned to the channel. On the other hand, if the channels are two or more, a new key-code KC is assigned to one of the channels.

However, a constant compared with identical-tone-color-off-channel-number data OFSMNO is not restricted to "1". A constant may be "2", "3" or more so that a new key-code can be assigned to one of these channels when the number thereof is greater than the constant. Otherwise, the test at step 112 can be omitted so that a new key-code is always assigned to one of these channels as long as one or more channels that satisfy the condition, i.e., as long as there is at least one musical-tone-signal-generating channel which is generating a musical-tone signal of the same tone-color to that of a musical-tone signal to be generated from now on, and whose dumping data DMP is smaller than the dumping-limit data DMPLMT.

(2) In the embodiment described above, the maximum number of musical-tone-signal-generating channels that can generate musicaltone signals of identical tone color is restricted by the maximum-tone-generating-number data MAXCH(LCH) at step 120, this restriction, however, can be omitted so that musical-tone signals of identical tone color can be generated up to the number of musical-tone-signal-generating channels.

(3) The embodiment has a restriction specified by the decision at step 107 in FIG. 6A: when a new key-code KC is assigned to a musical-tone-signal-generating channel of an identical tone color, the value of dumping data DMP must be less than or equal to the dumping-limit data DMPLMT. However, this restriction can be omitted. Moreover, although different dumping-limit data DMPLMT are used for each tone color in the embodiment, a common dumping-limit data can be used to all the tone colors.

(4) The embodiment has 16 communication channels (logical channels), and 12 musical-tone-signal-generating channels. However, the numbers of these channels are not restricted to those quantities, and can be specified arbitrary.

(5) In the embodiment above, dumping data DMP(i) is set to "$FF_H$" on a key depression and to "$7F_H$" on a key release regardless of tone color. These values, however, can be changed according to tone colors of musical-tone signals to be generated.

(6) The embodiment described above is an example in which the invention is applied to musical-tone-signal-generating apparatus having no keyboard. The invention, however, can be applied to an electronic musical instrument having performance operational means such as a keyboard.

Accordingly, it is intended that the invention be limited only by the scope of the appended claims.

What is claimed is:

1. A musical-tone-generating-control apparatus comprising:

musical-tone-signal-generating means having a plurality of musical-tone-signal-generating channels for generating musical-tone signals, controlling the generation of musical-tone signals according to tone-pitch information supplied to each of said musical-tone-signal-generating channels, and controlling tone colors of said musical-tone signals according to tone-color-control parameters;

tone-color-parameter-memory means for storing said tone-color-control parameters;

input means for entering primary information representing tone pitches of said musical-tone signals, and for entering secondary information representing tone colors of said musical-tone signals;

assigning means for selecting one of said musical-tone-signal-generating channels according to a predetermined rule, and for assigning said primary information to said selected musical-tone-signal-generating channel;

output means for supplying said assigned primary information to said musical-tone-signal-generating means to control generation of said musical-tone signal produced from said selected musical-tone-signal-generating channel according to said primary information, and for supplying said tone-color-control parameters corresponding to said secondary information in said tone-color-parameter-memory means to control tone colors of said musical-tone signals; and output inhibiting means for inhibiting output of said tone-color-control parameters to said musical-tone-signal-generating means when a tone color represented by said secondary information is the same as the tone color of said musical-tone signal previously generated in said selected musical-tone-signal-generating channel.

2. A musical-tone-generating-control apparatus as defined in claim 1 further comprising:

tone-color-information-storing means having a plurality of memory areas each of which corresponds to each of said musical-tone-signal-generating channels, updating tone-color information representing a tone color of said musical-tone signal generated in each of said musical-tone-signal-generating channels according to the assignment of said primary information, and storing updated tone-color information to each said memory area: and priority-assigning-control means for controlling said assigning means so that said primary information is assigned to a musical-tone-signal-generating channel previously generating musical-tone signal of the same tone color as that of said secondary information.

3. A musical-tone-generating-control apparatus as defined in claim 2 wherein said priority-assigning-control means measures elapsed time from key depression or from key release to present dumping data decreasing with said elapsed time, and firstly searches musical-tone-signal-generating channels whose dumping data are 0, and which had generated musical-tone signal of the same tone color as that of the musical-tone signal generated from now on, and said priority-assigning-control means assigns said primary information to one of said musical-tone-signal-generating channels which was searched first.

4. A musical-tone-generating-control apparatus as defined in claim 3 wherein said priority-assigning-control means secondly searches a musical-tone-signal-generating channel which is generating a musical-tone signal of the same tone color as that of the musical-tone signal to be generated from then on, and whose dumping data is less than a predetermined value and is the minimum among the dumping data of said searched channels, and said priority-assigning-control means assigns said primary information to said musical-tone-signal-generating channel searched second.

5. A musical-tone-generating-control apparatus as defined in claim 4 wherein said priority-assigning-control means thirdly searches a musical-tone-signal-generating channel which is associated with a released key and whose dumping data is minimum, independent of tone colors of said musical-tone signals, and said priority-assigning-control means assigns said primary information to said musical-tone-signal-generating channel searched third.

6. A musical-tone-generating-control apparatus as defined in claim 5 wherein said priority-assigning-control means fourthly searches a musical-tone-signal-generating channel which is associated with a depressed key and whose dumping data is minimum, independent of tone colors and state of keys associated with said musical-tone-signal-generating channels, and said priority-assigning-control means assigns said primary information to said musical-tone-signal-generating channel searched fourth.

7. A musical-tone-generating-control apparatus as defined in claim 1 wherein the number of musical-tone-signal-generating channels that can generate musical-tone signals of the same tone color is restricted by a predetermined maximum-tone-generating-channel number.

8. A musical-tone-generating-control apparatus as defined in claim 1 wherein said input means includes a keyboard.

9. A musical-tone-generating-control apparatus as defined in claim 4 wherein said priority-assigning-control means searches a new musical-tone-signal-generating channel according to another search rule when the number of musical-tone-signal-generating channel producing musical-tone signal of the same tone color is less than a predetermined value.

10. A musical-tone-generating-control apparatus as defined in claim 9 wherein said predetermined value is 2.

11. A musical-tone-generating-control apparatus as defined in claim 3 wherein said dumping data is measured by counting dow timer interrupt signals from a predetermined initial value.

12. A musical-tone-generating-control apparatus as defined in claim 11 wherein said dumping data is set to "$FF_H$" when a key is depressed and "$7F_H$" when a key is released.

13. A musical-tone-generating-control apparatus as defined in claim 4 wherein said predetermined value is set for each tone color.

14. A musical-tone-generating-control apparatus as defined in claim 4 wherein said predetermined value is common to all the tone colors.

* * * * *